US011053729B2

(12) United States Patent
Romero et al.

(10) Patent No.: US 11,053,729 B2
(45) Date of Patent: Jul. 6, 2021

(54) DOOR SYSTEM AND METHOD WITH EARLY WARNING SENSORS

(71) Applicant: Overhead Door Corporation, Lewisville, TX (US)

(72) Inventors: Federico Romero, Corpus Christi, TX (US); Jason Lee Ryan, Corpus Christi, TX (US); Robert Augustine, Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 165 days.

(21) Appl. No.: 16/024,161

(22) Filed: Jun. 29, 2018

(65) Prior Publication Data

US 2020/0003003 A1 Jan. 2, 2020

(51) Int. Cl.

| | |
|---|---|
| ***E05D 15/02*** | (2006.01) |
| ***E06B 3/90*** | (2006.01) |
| ***G08B 3/10*** | (2006.01) |
| ***E05F 15/73*** | (2015.01) |

(52) U.S. Cl.

CPC ..... *E06B 3/90* (2013.01); *E05F 15/73* (2015.01); *G08B 3/10* (2013.01); *E05Y 2900/132* (2013.01)

(58) Field of Classification Search

CPC .... E06B 3/90; G08B 3/10; E05F 15/73; E05F 15/608; E05Y 2800/73; E05Y 2800/426; E05Y 2900/132; E05Y 2400/814; E05Y 2400/822; E05Y 2400/86; E05Y 2015/767

USPC ..... 49/42, 43

See application file for complete search history.

(56) References Cited

U.S. PATENT DOCUMENTS

| | | | | | |
|---|---|---|---|---|---|
| 4,586,441 | A * | 5/1986 | Zekich | E05G 5/02 | 109/8 |
| RE33,407 | E * | 10/1990 | Schwarz | G07C 9/22 | 49/42 |
| 5,694,867 | A * | 12/1997 | Diaz-Lopez | E05G 5/003 | 109/6 |
| 5,711,111 | A * | 1/1998 | Nyffenegger | E06B 3/90 | 49/42 |
| 5,878,529 | A * | 3/1999 | Huber | E06B 3/90 | 109/8 |
| 6,742,301 | B1 * | 6/2004 | Schwarz | E05G 5/003 | 49/42 |
| 8,015,754 | B2 * | 9/2011 | Slagel | E05F 15/76 | 52/79.1 |
| 8,171,864 | B2 * | 5/2012 | Mucio | E05G 5/003 | 109/3 |
| 8,819,855 | B2 * | 8/2014 | Prasad | G07C 9/00571 | 726/30 |
| 8,832,997 | B2 * | 9/2014 | Osann, Jr. | E05D 15/58 | 49/254 |
| 10,021,350 | B2 * | 7/2018 | Rayner | E05F 15/72 | |

(Continued)

*Primary Examiner* — Jerry E Redman

(74) *Attorney, Agent, or Firm* — Haynes and Boone, LLP

(57) ABSTRACT

A sensor system for a door is includes a door configured to provide selective access between a first area and a second area; a door controller for controlling whether the door can open or be in a closed and locked position; a motion sensor for detecting motion in an area proximate to the door, the motion sensor configured to be operatively connected to the door controller; an object recognition sensor for recognizing objects in an area proximate to the door and proximate to the area where motion sensor detects motion, the object recognition sensor configured to be operatively connected to the door controller.

14 Claims, 5 Drawing Sheets

(56) References Cited

U.S. PATENT DOCUMENTS

| | | | | |
|---|---|---|---|---|
| 2008/0028682 | A1* | 2/2008 | Casella | E05F 15/608 49/25 |
| 2008/0110093 | A1* | 5/2008 | Liles | E05F 15/73 49/42 |
| 2008/0244978 | A1* | 10/2008 | Soyugenc | E05F 15/608 49/42 |
| 2012/0090239 | A1* | 4/2012 | Hondius | E06B 3/90 49/27 |

* cited by examiner

DOOR SYSTEM AND METHOD WITH EARLY WARNING SENSORS

TECHNICAL FIELD

This patent disclosure relates generally to doors to secure areas and, more particularly, to a door system and method to detect an inappropriate approach to a door system and wrong way movement through a door system.

BACKGROUND

Doors have long been used to provide access from one area to another. Most doors allow two way access. Often two way access is not desired. For example, at airports, after passengers have debarked from an airplane, the passengers will leave a secure portion of an airport to an unsecure portion of the airport. A doorway to freely allow passengers to leave the secure area is desired. However, it is not desired to allow passage way through that doorway from the unsecured area to the secured area. Rather, movement into the secured area generally takes place through a different portal that required screening to both passengers and objects such as carry-on baggage.

To guard against unauthorized entry of either people or objects to a secured area by going the wrong way through an exit, security personal are located at the exits. However it is manpower intensive to locate security personnel at the exits. Further, relying on security personnel alone renders the exit security susceptible to human error. As such, it may be desirable to provide a door system and/or method of operation that can augment or, perhaps in some embodiments, replace human security personnel stationed at exits from secure areas to non-secure areas.

SUMMARY

The foregoing needs are met to a great extent by embodiments in accordance with the present disclosure, wherein, in some embodiments allows a door system and/or method of operation that can augment or, perhaps in some embodiments, replace human security personnel stationed at exits from secure areas to non-secure areas.

In one aspect, the disclosure describes a sensor system for a door includes a door configured to provide selective access between a first area and a second area; a door controller for controlling whether the door can open or be in a closed and locked position; a motion sensor for detecting motion in an area proximate to the door, the motion sensor configured to be operatively connected to the door controller; an object recognition sensor for recognizing objects in an area proximate to the door and proximate to the area where motion sensor detects motion, the object recognition sensor configured to be operatively connected to the door controller.

In another aspect, the disclosure describes a sensor system for a door including: a door assembly including a door configured to provide selective access between a first area and a second area; a door controller configured to control whether the door can open or be in a closed and locked position; a first and second wall connected to the door assembly, the first and second wall defining a corridor leading to the door assembly; a first motion sensor configured to detect motion in a first area, the motion sensor operatively connected to the door controller; an object recognition sensor system for recognizing objects in a second area, the object recognition sensor system operatively connected to the door controller.

In yet another aspect, the disclosure describes a method of limiting access through a door. The method including: sensing a first area for movement toward the door with a motion sensor; initialing a warning if movement is sensed toward the door; sensing movement toward the door in a second area with an object sensor; locking the door if movement toward the door is sensed in the second area with the object sensor.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
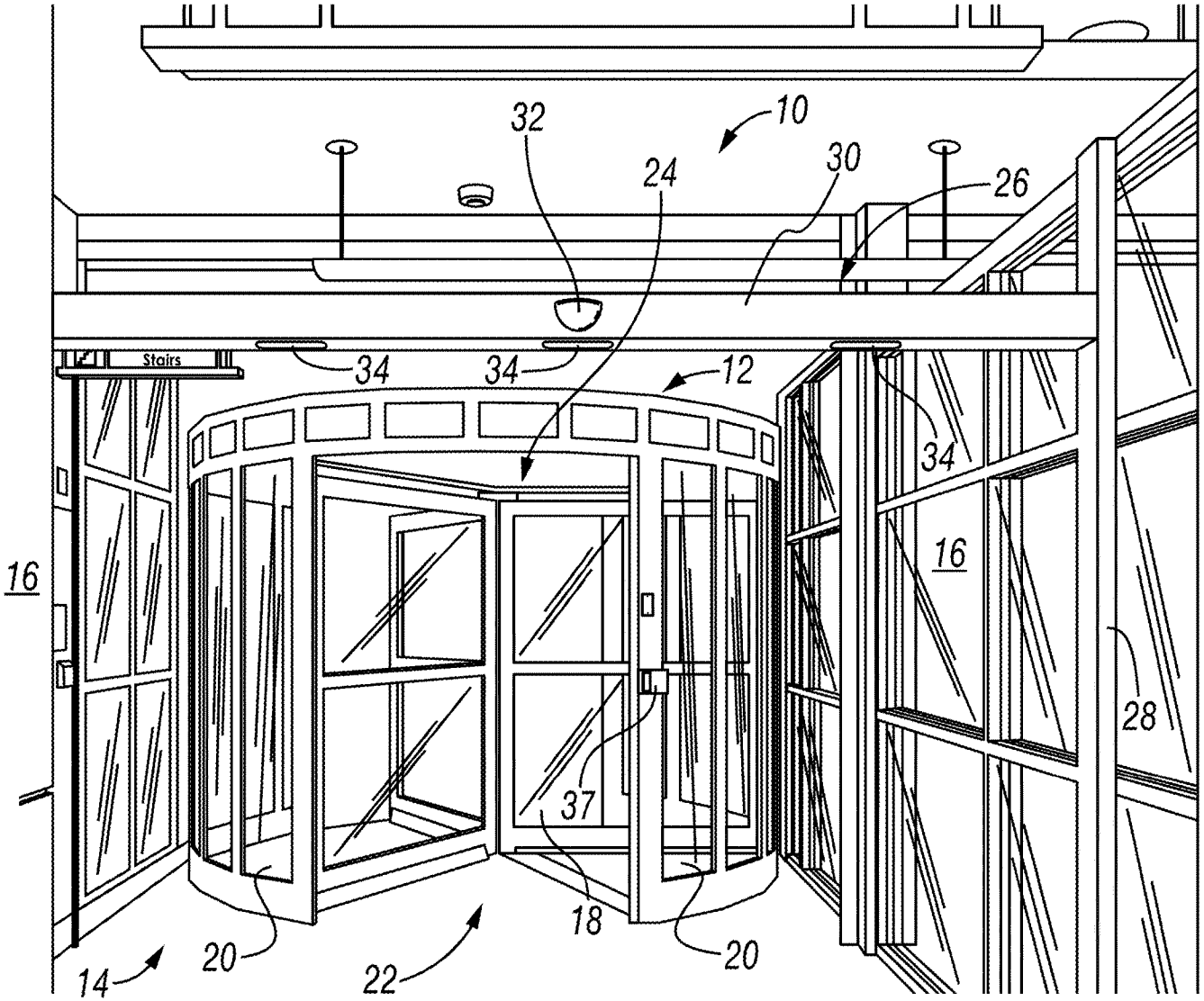
FIG. 1 is a perspective view of a door system having early warning sensors in accordance with one embodiment of the present disclosure.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

Figure 2:
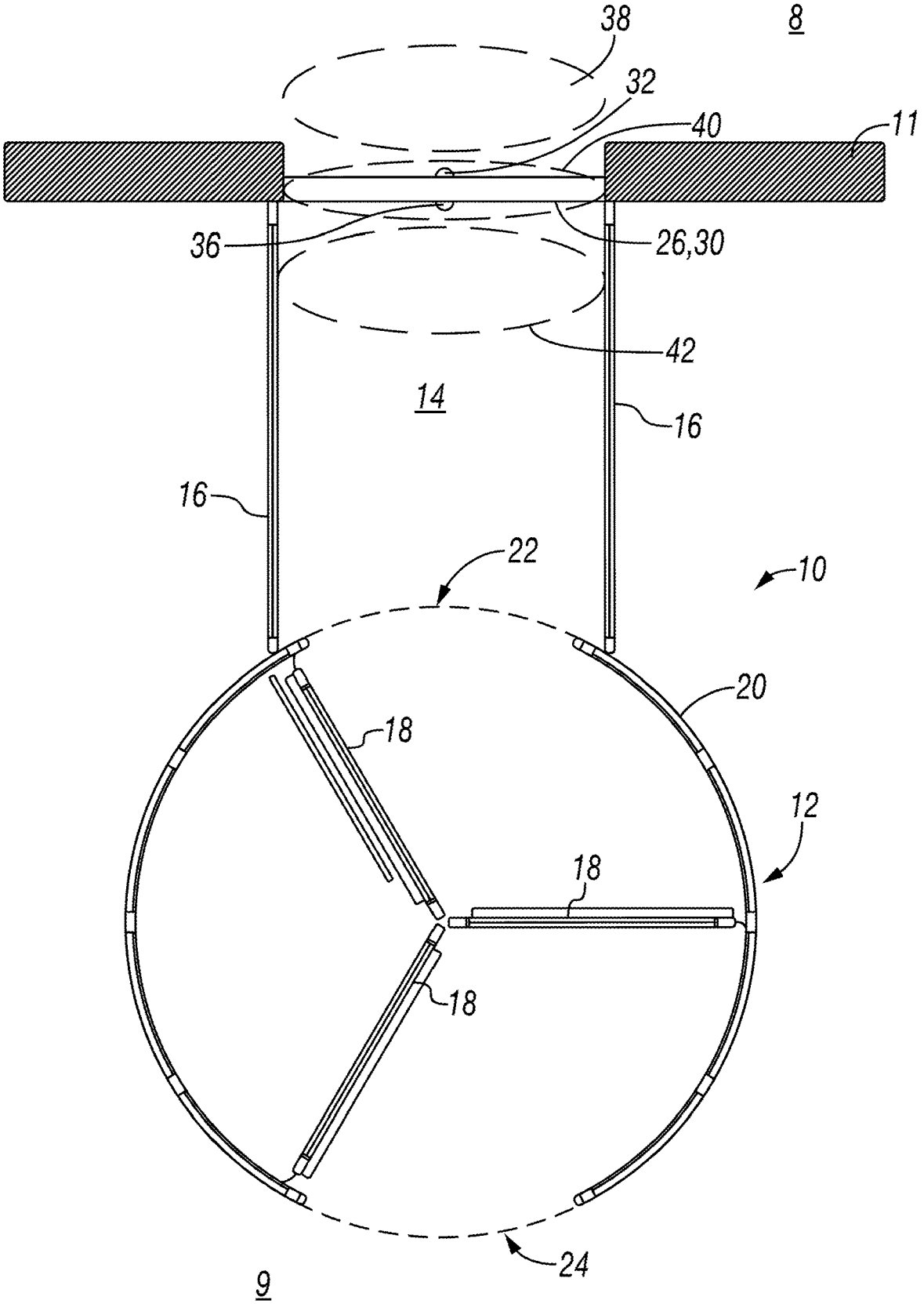
FIG. 2 is a top view of the door system in accordance with an embodiment of the present disclosure.

FIG. 1 is a perspective view of a door system 10 in accordance with the present disclosure. FIG. 2 is a top view of the door system 10 that provides passage through a wall 11 that separates a secure area 9 from a non-secure area 8. With reference to FIGS. 1 and 2, the door system 10 includes a revolving door assembly 12. Other embodiments may not use a revolving door assembly 12 but rather a different type door.

The door system 10 includes a corridor 14 defined by two sides or walls 16. The corridor 14 channels traffic that has exited the door assembly 12 on their way to the unsecured area 8. The door assembly 12 includes door panels 18, which, in the non-limiting embodiment shown, rotate. The door assembly 12 includes a shroud 20. The shroud 20 has openings 22 and 24 which constitute an entry 24 and exit 22 for the door assembly 12.

A sensor frame 26 is located in the corridor 14. The sensor frame 26 includes one or more side supports 28 and a header 30. The embodiment shown in FIG. 1 has only one side support 26 as the header 30 is supported at one end by a wall, but in other embodiments, the header 30 may be supported by a side support 28 at either end. In other embodiments, the header 30 may have one or no side supports 28 but rather is supported by walls or other structure.

The header 30 provides a mounting place for several sensors 32, 34, and 36. A first motion sensor 32 is mounted to the header 30 and oriented to detect movement in a first area 38 at or just in front of, the entry way to the corridor 14.

Another type of sensor or group of sensors 34 are also mounted to the header 30. These sensors 34 are referred to "counter sensors," "object recognition sensors" and/or lock down sensors 34. In some embodiments, the counter sensors 34 are configured to recognize a human body. For example, the counter sensors 34 may recognize a human head and shoulders. Once the recognition is made, the sensors 34 will count one human has passed by. The object recognition sensors 34 are mounted and oriented to monitor and count how many people pass through and area 40. The area 40 monitored by the counting sensors 34 may be located near the exit of the corridor as shown in FIG. 2. In order to monitor the entire area 40 multiple counter sensors 34 may be used. As shown in the example embodiment illustrated in the FIGS., three object recognition sensors 34 are used. It will be understood that in other embodiments, more or fewer sensors 34 may be used in order to monitor the entire area 40 desired to be monitored.

As seen in FIG. 2 a second motion sensor 36 (or sensors 36, if more than one are needed to monitor the entire area 42) are mounted to the header 30. The sensor 36 is configured to monitor area 42 in the corridor 14 for motion.

In some embodiments, the motion detection sensors 32 and 36 are sold and marketed as EAGLE Unidirectional activation sensor for automatic pedestrian doors, sold by BEA headquartered in Liege, Belgium, part of the Infrastructure Sensors Division of Halma plc. In some embodiments, the "counter sensors" are sold and marketed as the IRMA MATRIX sensors of the iris infrared intelligent sensors from iris-GmbH of Berlin, Germany.

A user interface 37, such as, a keypad 37 is mounted on the door shroud 20. The user interface 37 allows a user to interact with a controller associated with the door system 10 and will be explained further below.

Figure 3:
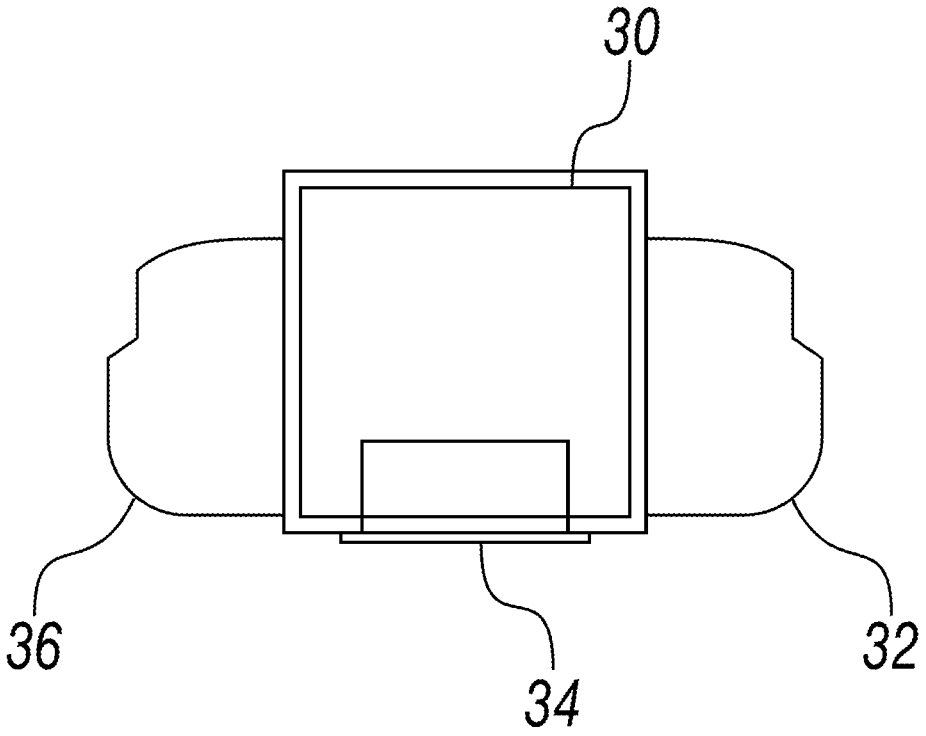
FIG. 3 is a partial cross-sectional view of the sensor header.

FIG. 3 is a partial cross-sectional view of the header 30. The header 30 in the embodiment shown in FIG. 3 is squire in shape and has a nominal dimension of 4 inches. It will be understood that in other embodiments, the header 30 may have other dimensions or shapes. Further, in other embodiments no header 30 may be used, as the sensors 32, 34, and 36 may be supported and oriented by other means (such as a ceiling, struts, a support frame, or other suitable structure).

Figure 4:
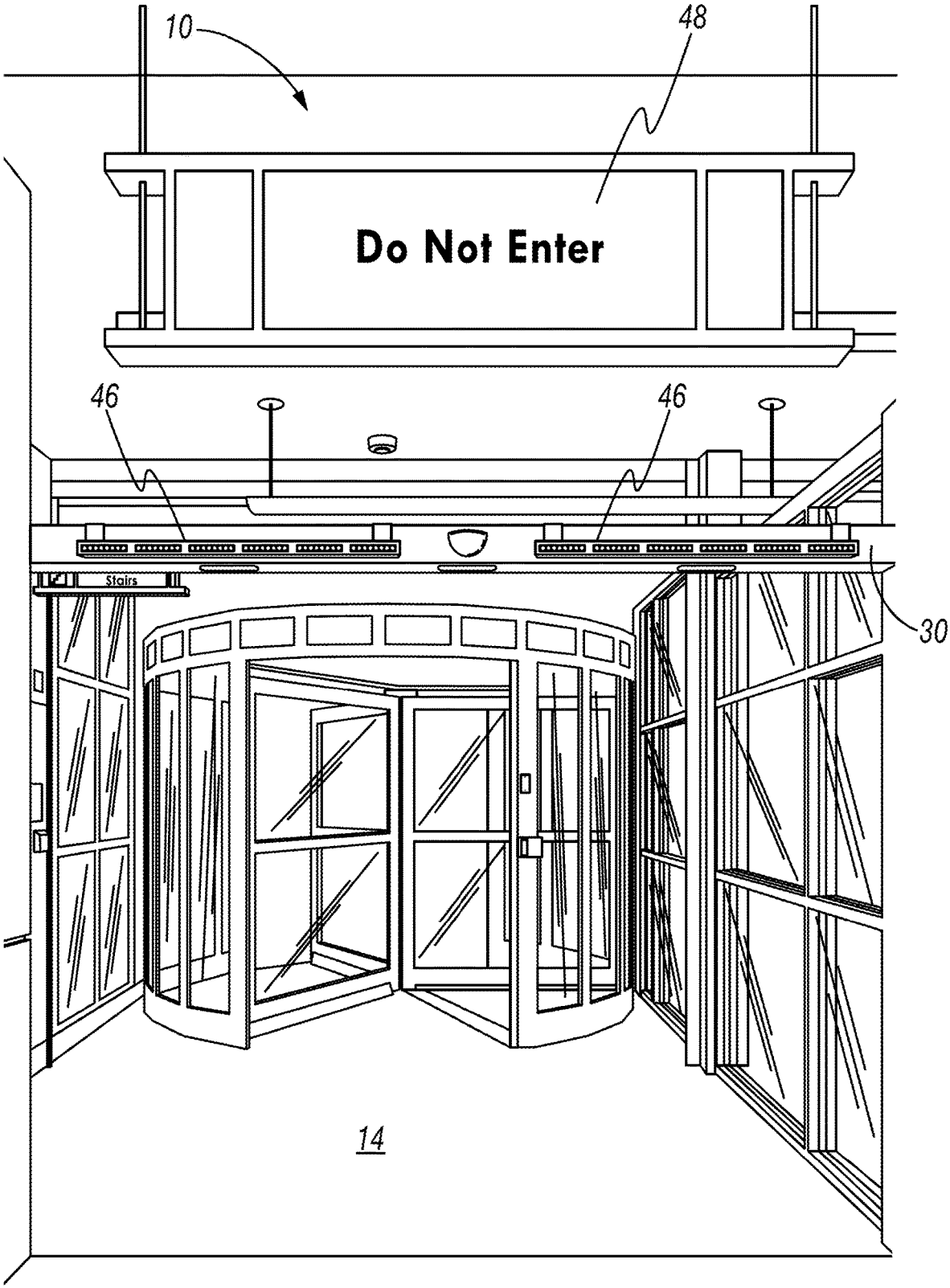
FIG. 4 is a perspective view of a door system having early warning sensors in accordance with another embodiment of the present disclosure.

FIG. 4 illustrates an embodiment where the door system 10 includes warning lights 46. The warning lights 46 may be mounted on the header 30 as shown in FIG. 4 or on any other suitable structure. In some embodiments, the warning lights 46 are located near the exit of the corridor 14. The warning lights 46 may also include or be located near an audible alarm.

In addition to warning lights 46, warning signs 48 may also be located near the exit of the corridor 14. The warning lights 46 and warning signs 48 are intended to warn and deter pedestrians from entering the corridor 14 from the exit.

Figure 5:
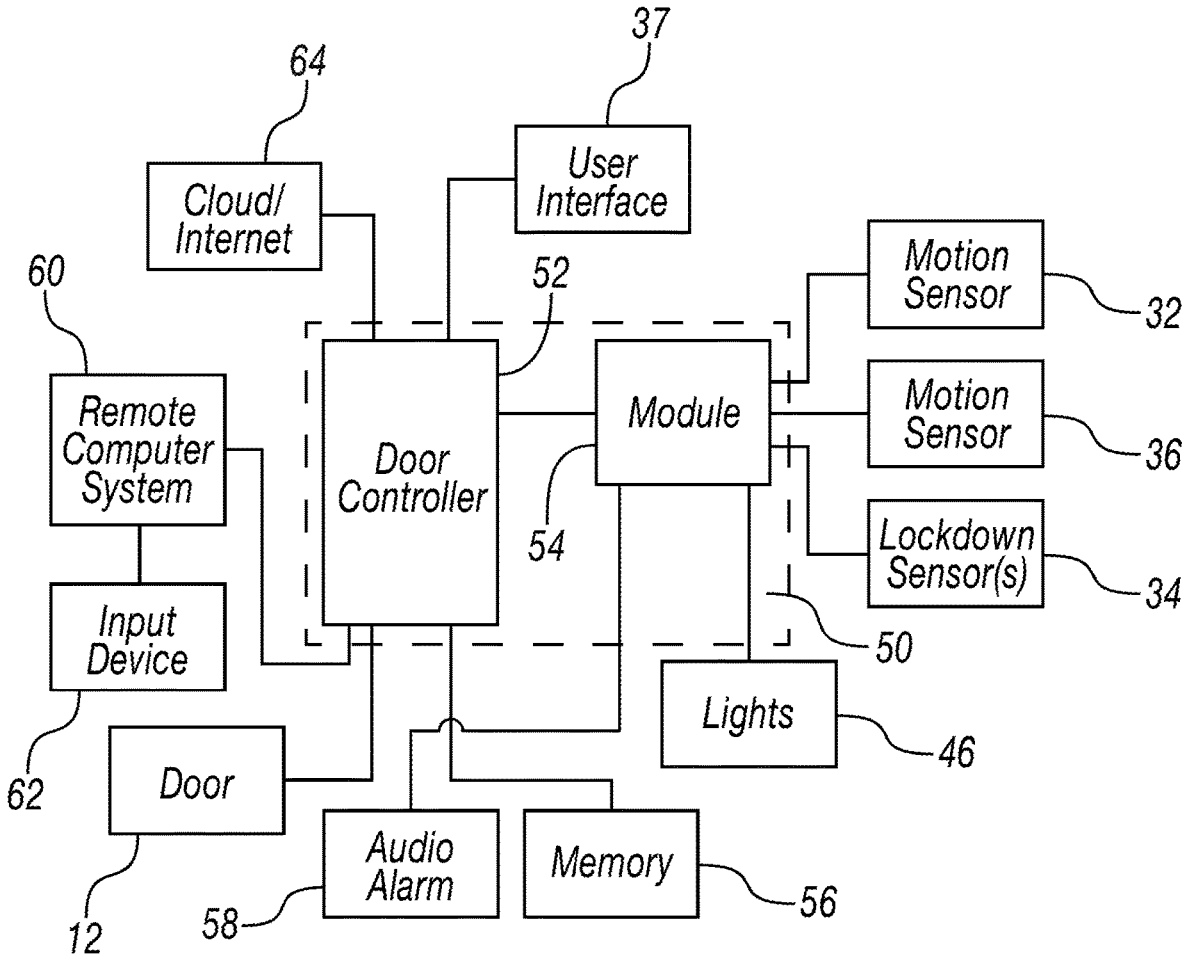
FIG. 5 is a schematic diagram of a door system controller in accordance with the disclosure.

Many revolving door systems have electronic controllers. The door system 10 also has an electronic controller 50 as shown in FIG. 5. In some embodiments, the electronic controller 50 may include the revolving door controller 52 with a module 54 added on. In other embodiments, the controller 50 may be an integrated controller. The controller 50 (or controllers 52, 54) may be an electronic microcontroller. The controller 50 receives inputs of the motions sensors 32, 36 and the lockdown or counter sensor(s) 34. The controller 50 also receives input from the user interface 37 and the memory 56. In some embodiments, the controller 50 may receive inputs from a remote computer system 60 which may have its own input device 62 and the internet and/or a remote cloud 64.

The door controller 50 outputs data and/or command signals to the lights, 46, memory 56, audio alarm 58, and door 12. In some embodiments, the door controller 50 may also output data and/or command signals to the remote computer system 60, the remote cloud and/or internet 64, the user interface 37 and the memory 56. It will be understood the the controller 50 may send or receive signals or commands to anything operatively connected to the controller 50.

In some embodiments, aspects of the door system 10 may be retrofitted to existing revolving door assemblies 12. For example, the Horton Automatic Series 9130 and/or Series 9131 ControlFlow one Way Security Revolving Door. It can be used on models with or without Light Curtain and Object Detection.

If a pedestrian approaches the door system 10 from the wrong direction (unsecured side 8), while there is no traffic exiting the door system 10, the early warning detection routine of the controller 50 signals the audible alarm 58 and/or initiates warning lights 46 to warn that pedestrian they are entering a prohibited area. If the pedestrian continues toward the door the lockdown detection sensors 34 signals the revolving door 12 to stop and instantly lockdown. When the revolving door 12 is stopped and locked down, no passage is possible through the revolving door 12. The lockdown may require a manual reset by a building official or unlock the door system 10. The reset may be done remotely such as via a remote computer system 60 or by the keypad/input device 37. The remote computer system 60 may be operated by a government security agency (such as the Transportation Security Agency (TSA)) or a private security security entity.

In some optional embodiments, when there is traffic flow exiting the door system 10 in the intended direction, this movement is sensed by the second motion sensor 36. The controller 50 is configured to disable or ignore signals from the first motion sensor 32 when movement is sensed from the second motion sensor 36 so that if a pedestrian approaches the door system 10 from the wrong direction 8, the early warning detection motion sensor(s) 32 and the audible alarm 58 and warning lights 46 will not activate. If that pedestrian continues toward the door system 10 the lockdown detection sensor(s) 34 signals the revolving door 12 to stop and instantly lockdown. The lockdown may require a manual reset by a building or government security official (for example a TSA or other security official).

Optionally, when the lockdown occurs, the early warning detection including the audible alarm 58 and warning lights 46 may activate. Events such as activation of the warning lights 46 and/or audible alarm 58 as well as a lockdown event may cause a warning or other signal to any of the cloud/internet 64 the remote computer system 60 and may be recorded in the memory 56. The warning or other signal may instigate additional monitoring of the door system 10 or other actions to be taken.

Typical minimum spacing between the lockdown sensors 34 and the revolving door 12 is about 10 to 11 feet. This space allows for exiting passengers who may dwell in the area just outside the revolving door 12 door without causing false alarms.

A typical width of exit travel lane is about 42 to 120 inches. In some embodiments, the distance from radius of revolving door 12 to the lockdown sensors 34 is about 10 feet. In some embodiments, mounting height for lockdown sensor 34 is about 84 inches maximum.

The early warning sensor 32 is typically a BEA Eagle Sensor set up for one-way traffic detection toward the restricted side of door. An additional Eagle Sensor 36 is mounted on the opposite side of the mounting tube or header 30 to disable the early warning sensor 32 while normal traffic is exiting the door 12. (This prevents possible false signaling of the early warning sensor 32.

The lockdown sensor(s) 34 may reliably discriminate between normal exiting traffic and unauthorized traffic attempting to approach the restricted side of the revolving door 12. When a pedestrian is detected traveling in the unauthorized direction this sensor 34 initiates an immediate lockdown of the door 12. Both or either the early warning sensor 32 and the lock down sensor(s) 34 may also detect objects moving the wrong way as well as pedestrians.

As discussed above, both early warning sensors 32, 35 and lockdown sensors 34 are connected to the revolving doors' master control 52 and locking system through an intelligent interface module 54 to insure accurate warning and lockdown signals.

The module 54 may be particularly useful when expanding and existing revolving door 12 to include the additional components of the full door system 10. The additional capabilities of the door system control 50 may be achieved by connecting the module 54 to the master control 52. Where a full door system 10 is used from the beginning rather than upgrading a revolving door 12, the door system may include the module 54 and the door controller 52 or include the capabilities of the module 54 in an integrated door controller 50.

While the disclosure has been described in terms of exemplary aspects, those skilled in the art will recognize that the disclosure can be practiced with modifications in the spirit and scope of the appended claims. These examples given above are merely illustrative and are not meant to be an exhaustive list of all possible designs, aspects, applications or modifications of the disclosure.

We claim:

1. A door system comprising:

a door configured to provide selective access through the door system;

a door controller configured to control whether the door can open or be in a closed and locked position;

a first motion sensor configured to detect motion in a first area proximate to the door, the first motion sensor configured to be operatively connected to the door controller;

an object recognition sensor configured to recognize objects in a second area proximate to the door and proximate to the first area, the object recognition sensor configured to be operatively connected to the door controller; and a sensor header configured to have the first motion sensor and the object recognition sensor mounted to the sensor header in a manner to allow the first motion sensor to monitor the first area proximate to the door and the object recognition sensor to monitor the second area proximate to the door and proximate to the first area;

wherein the door system is configured to freely permit passage of pedestrians through the door system from a first side of the door and to prevent passage of pedestrians through the door from a second side of the door on which the first motion sensor is disposed based upon a direction of approach of the pedestrians.

2. The door system of claim 1, wherein the door is a revolving door.

3. The door system of claim 1, wherein the door controller comprises:

a microcontroller configured to:

receive inputs from the first motion sensor and the object recognition sensor; and send outputs to an alarm system, a door assembly for controlling whether the door is free to open or remain in a locked position, a memory, and a remote computer system, wherein the controller is configured to control the outputs based on the inputs.

4. A door system comprising:

a door configured to provide selective access through the door system;

a door controller configured to control whether the door can open or be in a closed and locked position;

a first motion sensor configured to detect motion in a first area proximate to the door, the first motion sensor configured to be operatively connected to the door controller;

an object recognition sensor configured to recognize objects in a second area proximate to the door and proximate to the first area, the object recognition sensor configured to be operatively connected to the door controller; and a second motion sensor configured to detect motion in a third area proximate to the door, the second motion sensor configured to be operatively connected to the door controller to cause the first motion sensor to be deactivated or have signals from the first motion sensor ignored by the door controller if the second motion sensor detects motion;

wherein the door system is configured to freely permit passage of pedestrians through the door system from a first side of the door and to prevent passage of pedestrians through the door from a second side of the door on which the first motion sensor is disposed based upon a direction of approach of the pedestrians.

5. The door system of claim 4, further comprising a second object recognition sensor for recognizing objects in a fourth area proximate to the door and proximate to the first area, the second object recognition sensor configured to be operatively connected to the door controller.

6. A door system comprising:

a door assembly including a door configured to provide selective access through the door system;

a door controller configured to control whether the door can open or be in a closed and locked position;

a first and second wall connected to the door assembly, the first and second wall defining a corridor leading to the door assembly;

a first motion sensor configured to detect motion in a first area, the first motion sensor operatively connected to the door controller;

an object recognition sensor system configured to recognize objects in a second area, the object recognition sensor system operatively connected to the door controller; and a second motion sensor configured to detect motion in a third area, the second motion sensor operatively connected to the door controller;

wherein each of the first, second, and third areas is different from each other area but overlaps a part of at least one other area of the first, second, and third areas; and wherein the door system is configured to freely permit passage of pedestrians through the door system from a first side of the door and to prevent passage of pedestrians through the door from a second side of the door on which the first motion sensor is disposed based upon a direction of approach of the pedestrians.

7. The door system of claim 6, further comprising a sensor header located over the corridor wherein the first motion sensor, the second motion sensor, and the object recognition sensor system are mounted to the sensor header in a manner to allow the first motion sensor to monitor the first area, the object recognition sensor system to monitor the second area, and the second motion sensor to monitor the third area.

8. The door system of claim 7, wherein the second motion sensor is attached to the sensor header.

9. The door system of claim 6, wherein the object recognition sensor system includes at least one object recognition sensor.

10. The door system of claim 9, wherein the object recognition sensor system includes three object recognition sensors.

11. The door system of claim 6, further comprising an alarm system operatively connected to the door controller can configured to activate when at least one of the first motion sensor or the object recognition sensor system detects an object moving toward the door.

12. The door system of claim 6, wherein the door controller includes:

a microcontroller configured to:

receive inputs from the first motion sensor and the object recognition sensor system; and send outputs to an alarm system, the door assembly for controlling whether the door is free to open or remain in a locked position, a memory, and a remote computer system, wherein the controller is configured to control the outputs based on the inputs.

13. The door system of claim 12, wherein at least one of the outputs and inputs include an internet connection.

14. The door system of claim 6, wherein the door is a revolving door.

* * * * *